US005997212A

United States Patent [19]

Takada et al.

[11] Patent Number: 5,997,212

[45] Date of Patent: Dec. 7, 1999

[54] COVER FOR UNDERGROUND STRUCTURES, BODY THEREOF AND FRAME THEREFOR

[75] Inventors: Hiroyoshi Takada; Junji Wada, both of Fukuoka; Kyozo Sahara, Nagasaki-ken; Atsushi Nishitani, Fukuoka; Koji Terada, Yokohama, all of Japan

[73] Assignee: Hinode, Ltd., Fukuoka, Japan

[21] Appl. No.: 08/880,244

[22] Filed: Jun. 23, 1997

[30] Foreign Application Priority Data

Sep. 30, 1996 [JP] Japan ..... 8-259308

[51] Int. Cl.[6] ..... E02D 29/14

[52] U.S. Cl. ..... 404/25; 404/19

[58] Field of Search ..... 404/25, 26, 2, 404/19, 21, 4, 5; 52/19, 20; 137/247.11, 532.1

[56] References Cited

U.S. PATENT DOCUMENTS

| | | | |
|---|---|---|---|
| 314,781 | 3/1885 | Beckwith . | |
| 2,073,814 | 3/1937 | Small . | |
| 4,203,686 | 5/1980 | Bowman | 404/25 |
| 4,969,770 | 11/1990 | Bowman | 404/26 |
| 5,312,202 | 5/1994 | Newton | 404/25 |
| 5,318,376 | 6/1994 | Prescott, Sr. | 404/26 X |
| 5,366,317 | 11/1994 | Solimar | 404/25 |
| 5,499,888 | 3/1996 | Hawkes | 404/19 |
| 5,807,021 | 9/1998 | Aaron | 404/19 |

FOREIGN PATENT DOCUMENTS

| | | | |
|---|---|---|---|
| 222052 | 7/1962 | Austria | 404/25 |
| 2252013 | 6/1975 | France . | |
| 58-42252 | 3/1983 | Japan . | |
| 60-27160 | 2/1985 | Japan . | |
| 63-86156 | 6/1988 | Japan . | |
| 7-39964 | 9/1995 | Japan . | |
| 27088 | 11/1910 | United Kingdom | 404/25 |
| 201018 | 7/1923 | United Kingdom | 404/25 |
| 492190 | 9/1938 | United Kingdom | 404/25 |

*Primary Examiner*—James A. Lisehora
*Attorney, Agent, or Firm*—Jordan and Hamburg LLP

[57] ABSTRACT

A cover for underground structures, its cover body, and its frame designed to quickly discharge accumulations of rainwater and dirt so as to prevent slipping and skidding from increasing due to these accumulations. The cover body has a multiplicity of patterns of projections and depressions on its surface, one projection independent of another, so that the upper surface of each projection is on about the same level as that of the frame with the depressions formed to surround each of these depressions. The depressions are constructed to become gradually deeper from the central part of the cover body toward the periphery, while the frame also has depressions set up on part or all of its upper surface in a circumferential direction with discharge guides sloping up toward the outer periphery of the frame. The cover for underground structures is made up of a set of the cover body and the frame.

16 Claims, 12 Drawing Sheets

(a)

(b)

(a)

(b)

(a)

(b)

COVER FOR UNDERGROUND STRUCTURES, BODY THEREOF AND FRAME THEREFOR

BACKGROUND OF THE INVENTION

1. Field of the Invention

The present invention relates to covers, cover bodies and frames, and more particularly to covers for underground structures, cover bodies which are designed to quickly discharge rainwater and dirt collected from the cover bodies and the frames to efficiently prevent pedestrians from slipping and vehicles from skidding, and frames for the cover bodies.

Covers for underground structures herein refers to large iron covers to close openings which lead to buried materials as well as to structural sewerage facilities, manhole covers, covers for house inlets, openable and closable iron covers for common-use tunnels which protect equipment for underground power and communications facilities, iron covers for electric power transmission, iron covers for power distribution, fire hydrant covers functioning as openable and closable doors to connect underground conduits in waterworks systems, covers leading to gas pipes and their accessories from above ground, sluice valve covers, air-valve covers, covers for gas pipes, and water-gauge valves.

2. Description of the Prior Art

It is a known method to form a multiplicity of protruding and recessed patterns on the surfaces of cover bodies and frames of underground structures installed on sidewalks and roadways to prevent pedestrians from slipping and vehicles from skidding in inclement weather.

There are good examples of cover bodies and frames with improved surface patterns for slip and skid prevention disclosed in Japanese Unexamined Utility Model Publication No. 27160/85 and Japanese Utility Model Publication No. 39964/95.

The former concerns a cover body, the surface of which projections of a planar hexagon and planar Y-shaped depressions are alternately and uniformly distributed to form specific patterns, the projections being enclosed by depressions. Such surface patterns are supposed to prevent slipping and skidding regardless of which direction the pedestrians and vehicles advance from. Since the depressions formed around the projections are all connected, they are advantageous in that any dirt collected on the surface thereof can be discharged by using the depressions as cleaning passageways.

The latter method as disclosed in the Gazette presents anti-slip patterns formed on the upper surface of the wall of a flange of a frame. Slip prevention is made by means of each pattern made up of wavy grooves provided peripherally along the flange wall and single holes formed relative to the top and the bottom of the wavy grooves.

However, according to the Utility Model disclosed in Japanese Unexamined Utility Model Publication No. 27160/85, an outer rim is formed around the outer periphery of the cover body. Consequently, even though the depressions as such are all connected, they are surrounded by the outer rim when the cover body is considered as a whole. Further, these depressions merely form a flat surface which is depressed at a uniform depth with respect to the upper surface level, and any difference in level existing between the depressions and the outer rim is on the level of approximately at a right angle or a slope created due to cast trimming, so that guiding accumulations of rainwater and dirt in the depressions to the periphery for discharge thereof will require some degree of human work. It is unreasonable to expect natural discharge thereof with the passage of time.

Another factor is that, since the upper surface of the projections is also a flat surface on a uniform level, rainwater and dirt will remain collected on the upper surface thereof.

In regard to a frame described in Japanese Utility Model Publication No. 39964/95, inasmuch as the anti-slip patterns formed on the upper surface of a flange are depressed relative to the surrounding area, hence constituting closed depressions, rainwater and dirt will likely remain collected, as well.

As described above, the discharge of rainwater and dirt, once accumulated on the surface of the body and the frame in the existing structure, is difficult, and the accumulations thereof tend to remain unchanged. Since such accumulations of rainwater and dirt on the surface act between tires and the surface of the body or frame, for example, as a roller, despite the provision of anti-slip and anti-skid patterns in projections and depressions on the surface thereof, there is the problem of significant loss of effect.

SUMMARY OF THE INVENTION

It is therefore an object of the present invention to provide a cover for underground structures, a body thereof, and a frame thereof which can quickly discharge the accumulations of rainwater, dirt and other matters and prevent the undesired effect on slipping and skidding due to the accumulations.

The cover body for underground structures according to this invention have on the surface thereof patterns of projections and depressions by means of a plurality of projections, one independent from another, with an upper end surface thereof approximately on the same level as that of the frame and depressions surrounding such projections, is characterized in that the above-mentioned depressions are constructed to be gradually deeper from the center of the body to the periphery thereof. This method ensures that rainwater and other matter will flow to the periphery of the body.

Moreover, the cover body for underground structures according to this invention on which formed patterns of projections and depressions on the surface thereof, as well as an outer rim on the periphery thereof, is characterized by the provision of guide surfaces from the bottom of the depressions adjacent to the outer rim to the upper surface of said outer rim, which are sloped upward toward the outer periphery of the cover body. The provision of such guide surfaces facilitates guiding the rainwater, dirt, and other matter deposited in the depressions to a point off the body, thereby promoting the quick discharge of rainwater and dirt.

Still further, the cover body for underground structures according to this invention is characterized by the provision of sloped surfaces on the upper surface of the projections downward to the periphery thereof and/or drainage grooves opening toward the periphery thereof. Formation, on the upper surface of the projections, of downward slopes and drainage grooves toward the periphery of said projections enables rainwater and dirt deposited on thereon to be discharged to the depression, thus maintaining the anti-slip effect due to the surface of the projections.

The frame for covers for underground structures according to this invention is additionally characterized in that depressions are provided partially in the peripheral direction or over the entire periphery of the upper end of the frame so that discharge guides in the form of upward slopes to the periphery thereof are provided on these depressions.

It will be appreciated that the provision of discharge guides on the depressions makes it possible to quicken the discharge of rainwater and dirt in the same way as the guide surface of the body. It will also be appreciated that combinations of the cover bodies and the frames can constitute the covers for underground structures of this invention.

In such covers for underground structures, discharge effects on deposits on respective cover bodies and frames lead to a multiple effect, whereby deposits can be discharged even more quickly from the covers for underground structures as a whole.

BRIEF DESCRIPTION OF THE DRAWINGS

The present invention as defined in the claims can be better understood with reference to the text and to the following drawings, as follows:

FIG. 7(*a*) shows a perspective view;

FIG. 7(*b*) shows a longitudinal sectional view of a main part;

FIG. 8(*a*) shows a perspective view;

FIG. 8(*b*) shows a longitudinal sectional view of a main part;

FIG. 9(*a*) shows a perspective view;

FIG. 9(*b*) shows a longitudinal sectional view of a main part;

DETAILED DESCRIPTION OF PREFERRED EMBODIMENTS

A cover body for underground structures according to this invention contains guide surfaces formed at a pitch in a circumferential direction from an outer rim of the cover body, with protrusions jutting out toward the central part of the cover body provided between one guide surface and another. Formation of such protrusions can increase the frictional force against tires and, in combination with discharge effects on accumulations on the guide surface, improve slip and skid prevention. Also, slopes and drainage grooves can be provided on projections formed on the body proper, while small protrusions and/or small recesses may be provided on the upper surface of all or part of the projections. The provision of these small protrusions and small recesses will increase the frictional force against tires and other matters.

Moreover, when projections having slopes and drainage grooves or small protrusions and small recesses are formed on the cover body, which has depressions becoming radially deeper from the central part thereof with the provision of guide surfaces on the outer rim, it becomes possible to discharge rainwater and dirt even more quickly, and simultaneously increases the frictional force against tires.

On the other hand, discharge guides may be provided on the depressions on the upper surface of a rim and protrusions jutting toward the inside of the depressions may also be provided on the outer peripheral wall and/or the inner peripheral wall forming the depressions. With this construction, slip and skid prevention effect improves in the same way as the provision of the guide surfaces and projections on the outer rim of the body.

Figure 1:
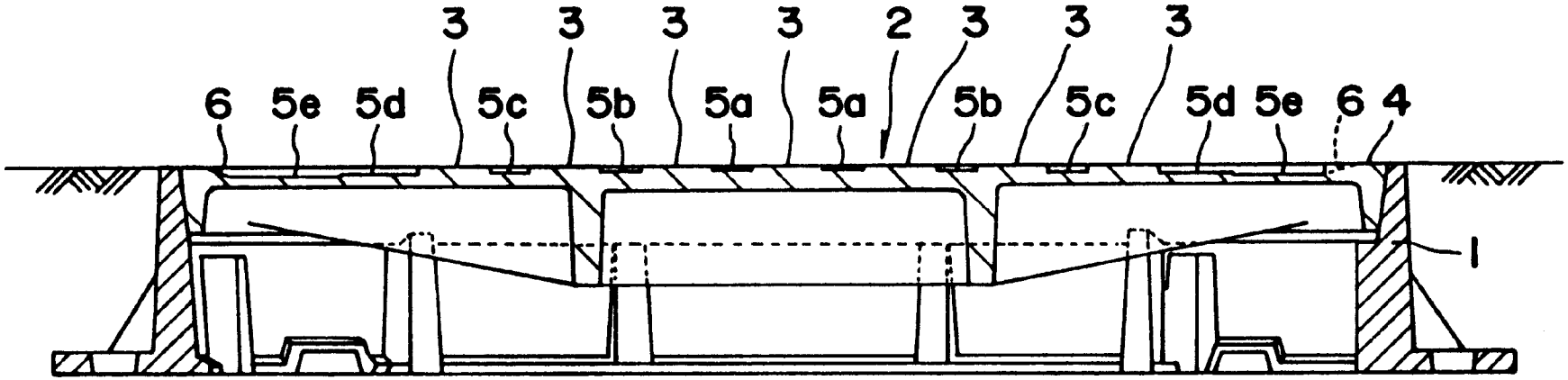
FIG. 1 is a schematic longitudinal section showing an embodiment of a cover body for underground structures according to this invention.

FIG. 1 is a longitudinal sectional view of a main part with a cover body for underground structures according to this invention placed on a frame therefor. In this drawing, a cover body 2 is conventionally taper-fit to a frame 1 installed underground with an upper surface thereof generally level with the road surface. As explained below, the cover body 2 has patterns of projections and depressions on the surface thereof, each projection being formed so that the level of an upper surface thereof is approximately on the same level as that of the upper surface of the frame 1.

Figure 2:
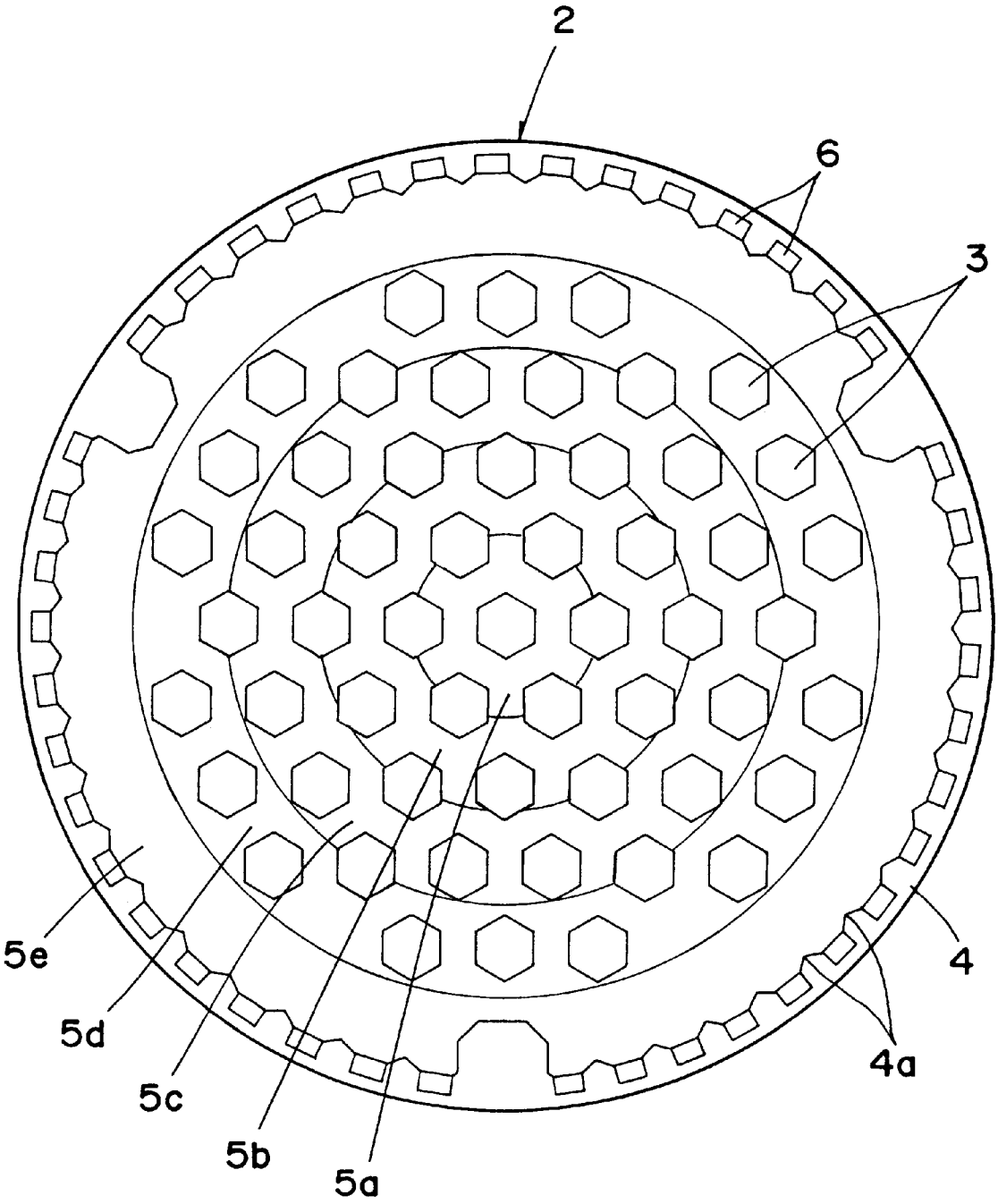
FIG. 2 is a plan view of the cover body.

FIG. 2 is a plan view of the cover body 2 with surface patterns, wherein projections 3 of a planar hexagon are respectively arranged independently, an outer rim 4 being formed on the periphery thereof. The upper surfaces of these projections 3 and the outer rim 4 are, as described above, at substantially the same level as that of the upper surface of the frame 1.

Figure 3:
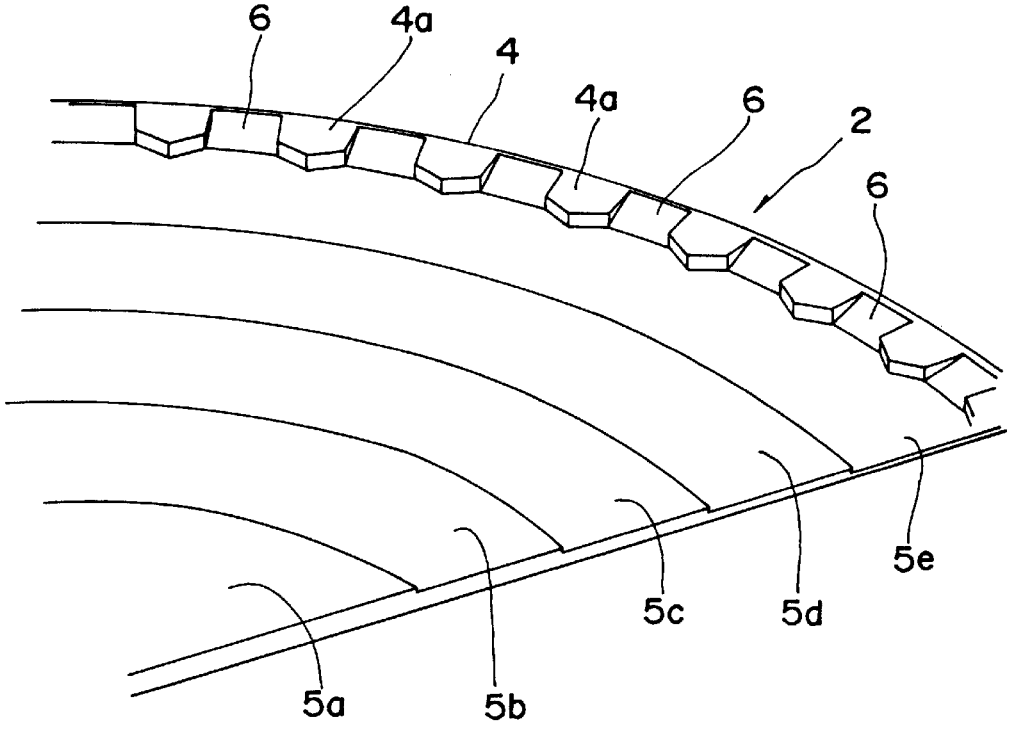
FIG. 3 is a perspective view of a main part partially broken away to show the shape of a difference in level and an outer rim of the depressions on the surface of the body.

On the surface of the cover body 2, there are formed patterns due to projections 3 with an additional stepped formation of five depressions 5*a*, 5*b*, 5*c*, 5*d*, and 5*e* in a concentric circular manner. FIG. 3 is a partially broken away perspective view of a main part of the surface of the cover body 2. As illustrated, the depressions 5*a* to 5*e* are so constructed that each has a flat bottom, the depression 5*a* in the central part being the shallowest and the depression 5*e* adjacent to the outer rim 4 being the deepest. As a consequence of such construction of the depressions 5*a* to 5*e*, when the depressions are under rainwater in the event of a rainfall, it is easier for the rainwater to flow radially from the central part of the cover body 2. Another advantage is that even the dirt covering the surface of the cover body 2 can be likewise radially guided from the central part as with the rainwater, due to rain or as a result of the wind pressure of passing vehicles, thus neither rainwater nor dirt remain at the central part of the cover body 2, thereby preventing slipping and skidding. It will also be appreciated that on the boundary part with the outer rim 4 adjacent to the depression 5*e* on the periphery are further provided guide surfaces 6 to facilitate discharge of rainwater and dirt from the depression 5*e*.

Figure 4:
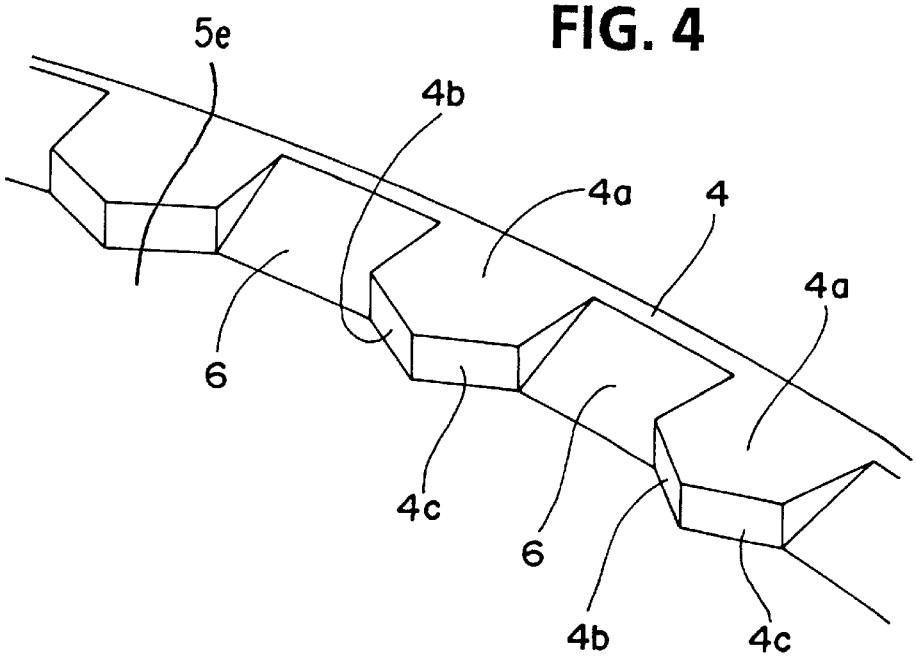
FIG. 4 is a partial perspective view to better illustrate the guide surfaces.

FIG. 4 is a partial perspective view illustrating the guide surfaces 6. The guide surfaces 6 which are connected to the bottom of the depression 5*e*, sloping up toward the outer periphery of the cover body 2, and gradually standing upright, are formed at a pitch in a circumferential direction, and in between one depression and another is positioned each protrusion 4*a* at the same level as that of the upper surface of the outer rim 4 jutting toward the central part of the cover body 2. Each of the protrusions 4*a* is constructed so that a part of the surface thereof facing the central part of the cover body 2 protrudes in a triangular shape, two sides thereof serving as guide sides 4*b* an 4*c* which lead rainwater and dirt to the guide surfaces 6 on both adjacent sides.

It will be appreciated that the provision of the guide surfaces 6 enables rainwater and dirt brought from the central part of the cover body 2 to the depression 5*e* on the periphery to be discharged via the guide surfaces 6, due to the passing of vehicular tires, to outside the cover body 2, hence more effectively preventing slipping and skidding.

A further advantage is that since there are provided in this embodiment protrusions 4*a*, each between the guide surfaces 6 jutting to the central part of the cover body 2, corners and straight portions of these protrusions 4*a* can increase the frictional force against pedestrians' shoes and vehicle tires to inhibit slipping and skidding more effectively. It is to be noted that each of the projections 3 of the cover body 2 is formed so that the level of the upper surface thereof substantially corresponds to that of the upper surface of the frame 1, and that the level of the upper surface thereof substantially corresponds to that of the road surface, presenting no obstacle to the movement of pedestrians or vehicles and thus assuring safety in passage.

Figure 5:
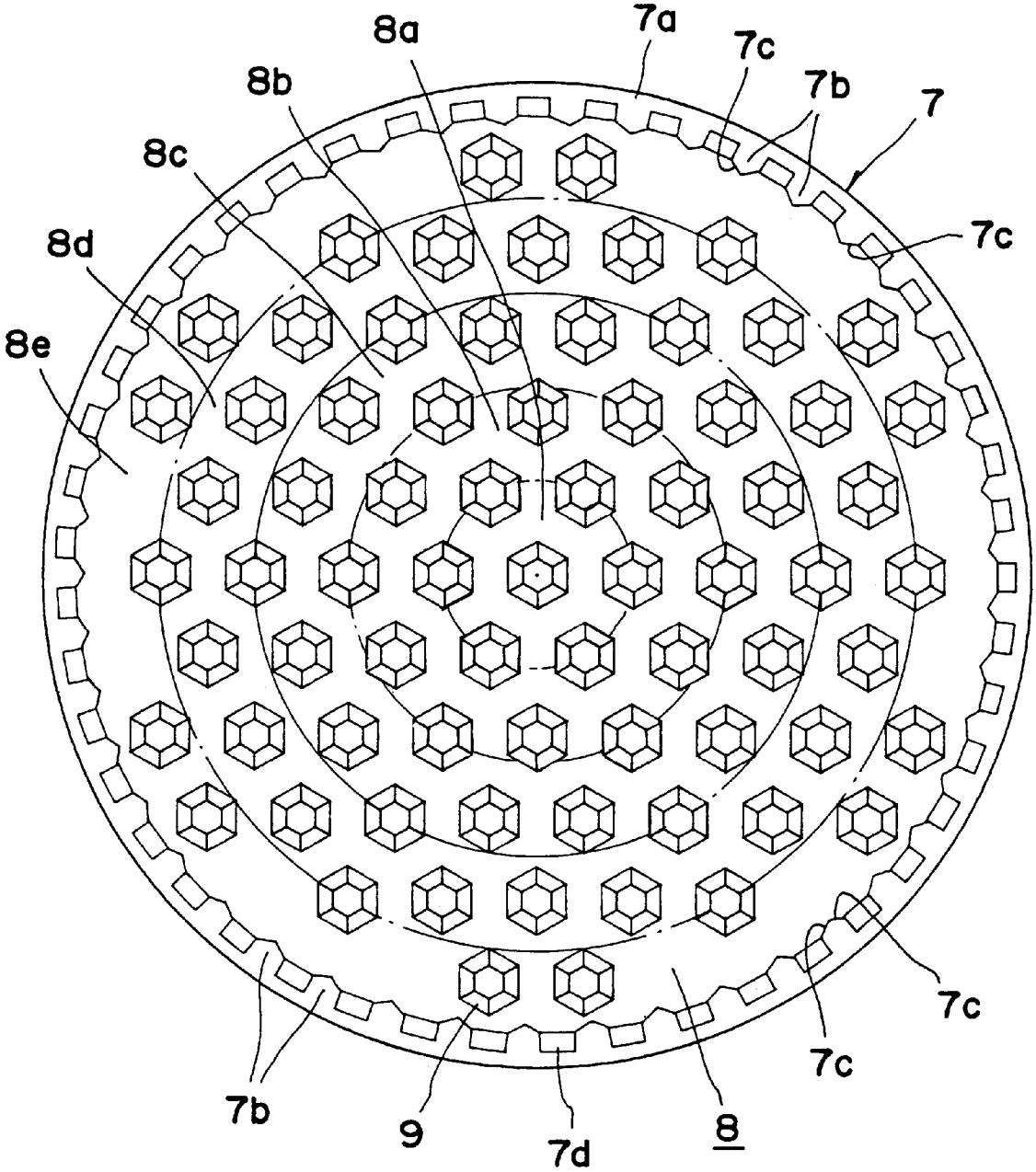
FIG. 5 is a plan view showing another embodiment of the cover body and concurrently showing a construction forming the step-shaped depressions in concentric circles.

FIG. 5 is a plan view of the second embodiment designed to prevent slipping and skidding by improving the shape of the projections provided on the surface of the cover body and by endowing the projections themselves with a discharge function for rainwater and dirt. In this drawing, the cover body 7 forms an outer rim portion 7*a* at the highest level of the entire unit, while a region surrounded by the outer rim portion 7*a* is made to be a depression 8 having a uniform depth. At the section where the outer rim portion 7*a* adjoins the depression 8, in the same way as explained in FIG. 4 with regard to the first embodiment, each guide surface 7*d* sloped from the bottom of the depression 8 upward to the upper surface of the outer rim portion 7*a* is formed at a pitch in the circumferential direction, and in between one guide surface 7*d* and another is provided a protrusion 7*b* having sides facing the central part of the cover body 7 as guide sides 7*c*.

In the illustrated embodiment are projections 9 in a planar hexagon shape on the upper surface, which is as high as or slightly lower than the upper surface of the outer rim part 7*a*, and each of the projections 9 is independently provided on the depression 8.

Figure 6:
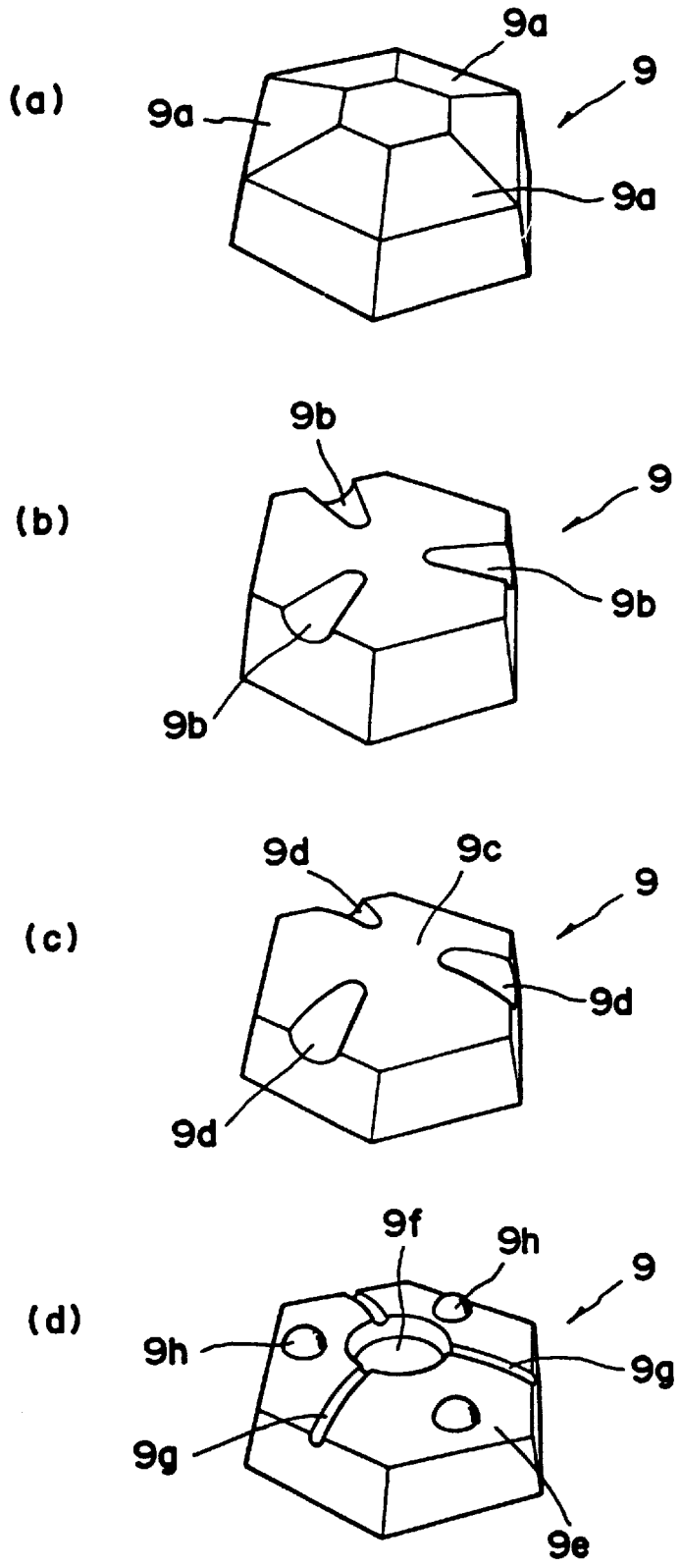
FIGS. 6(*a*)–6(*d*) are schematic perspective views to illustrate four embodiments of the depressions.

FIG. 6 respectively shows respective views of embodiments with specific shapes of the projections 9. View (a) of this drawing illustrates a formation of each sloped surface 9*a* in six faces with an exclusion of the central part of the upper surface. Each of these sloped surfaces 9*a*, though pointing to a different direction, slopes downward to the outer periphery of the projections 9, therefore facilitating discharge of rainwater and dirt accumulated on the upper surface of the projections 9 via the sloped surfaces 9*a* toward the depression 8 and maintaining the slip and skid prevention effect due to the projections 9.

View (b) thereof illustrates the upper surface being made substantially flat with drainage grooves 9*b* provided by cutting three locations. The central part sides of the drainage grooves 9*b* on the upper side XW are formed to be narrow and shallow, the width and depth increasing as the grooves 9*b* move toward the outer periphery, and opening at the outer periphery of the projections 9.

The drainage grooves 9*b* provide small protrusions and small recesses to the upper surface of the projections 9 for improving the slip and skid prevention effect, while promoting discharge of accumulated rainwater and dirt to the depression 8. Moreover, as shown in the illustrated embodiments, it is possible to accelerate the discharge of rainwater and dirt by making the drainage grooves 9*b* wider and deeper toward the periphery of the projections 9.

View (c) thereof illustrates the entire upper surface of each of the projections 9 as a sloped surface 9*c* in the form of a moderately curved surface, wherein drainage grooves 9*d* are formed at three locations in the same manner as the embodiment of the view (b) of the same drawing. It is to be understood that because of the formation of drainage grooves 9*d* in addition to the sloped surface 9*c* in this embodiment, a higher rainwater and dirt discharge effect is obtained than with the embodiments of (a) and (b) thereof.

View (d) illustrates the upper surface of each of the projections 9 as a sloped surface 9*e*, a small recess 9*f* being provided in the central part thereof, three drainage grooves 9*g* which extend therethrough being formed toward the outer periphery, and further small protrusions 9*h* of a hemispheric shape being provided at areas between these drainage grooves 9*g*.

In this embodiment, as with the embodiment of the view (c) thereof, on top of the discharge effect of rainwater and dirt due to the sloped surface 9*e* and the drainage grooves 9*g*, the frictional force against tires can be increased as a result of small protrusions 9*h* and the small recess 9*f*, leading to improvement of the slip and skid prevention effect.

Figure 7:
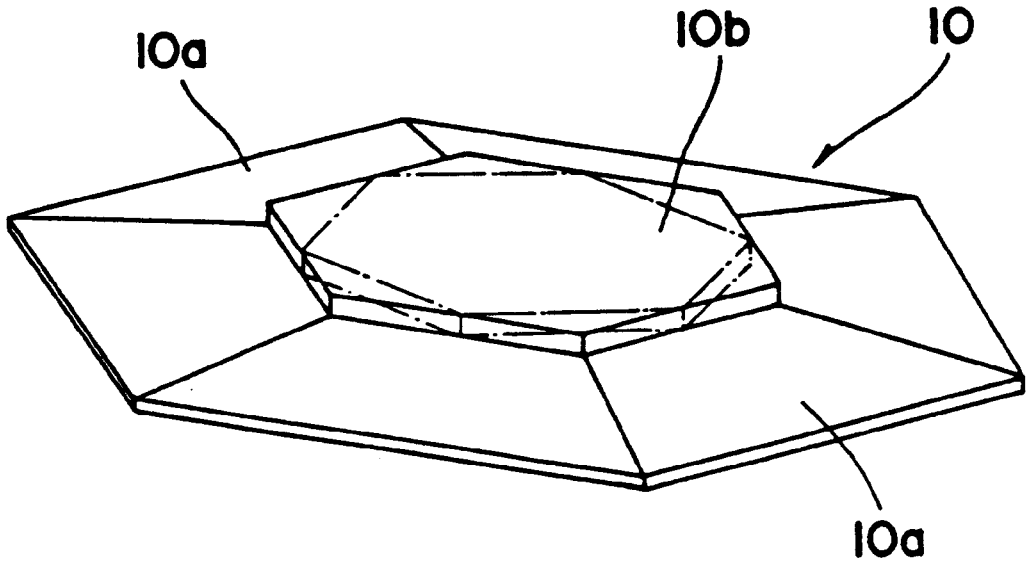
FIG. 7 illustrates another embodiment.
Figure 7:
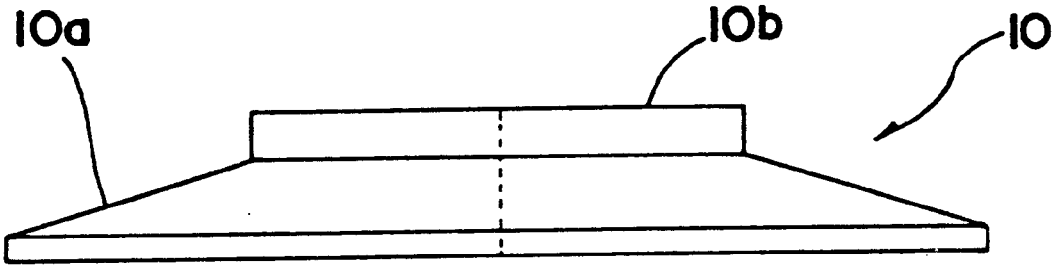
Figure 8:
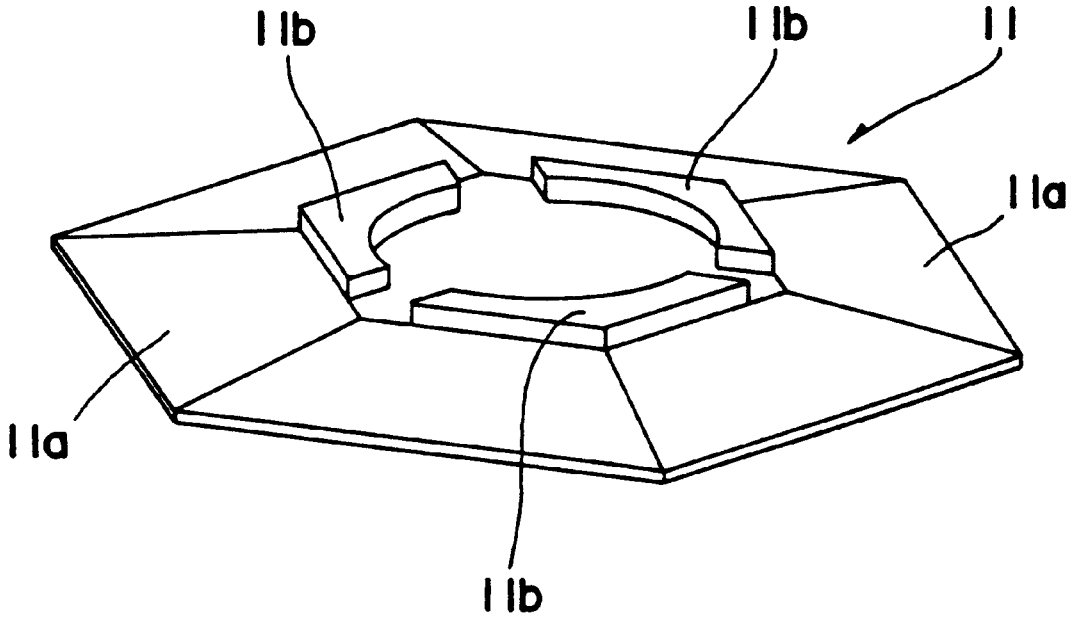
FIG. 8 illustrates still another embodiment.
Figure 8:
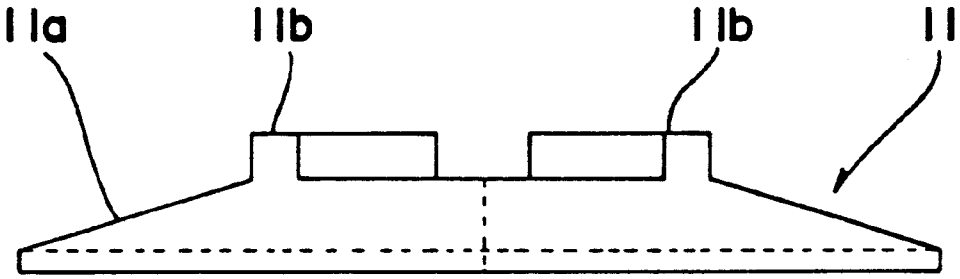
Figure 9:
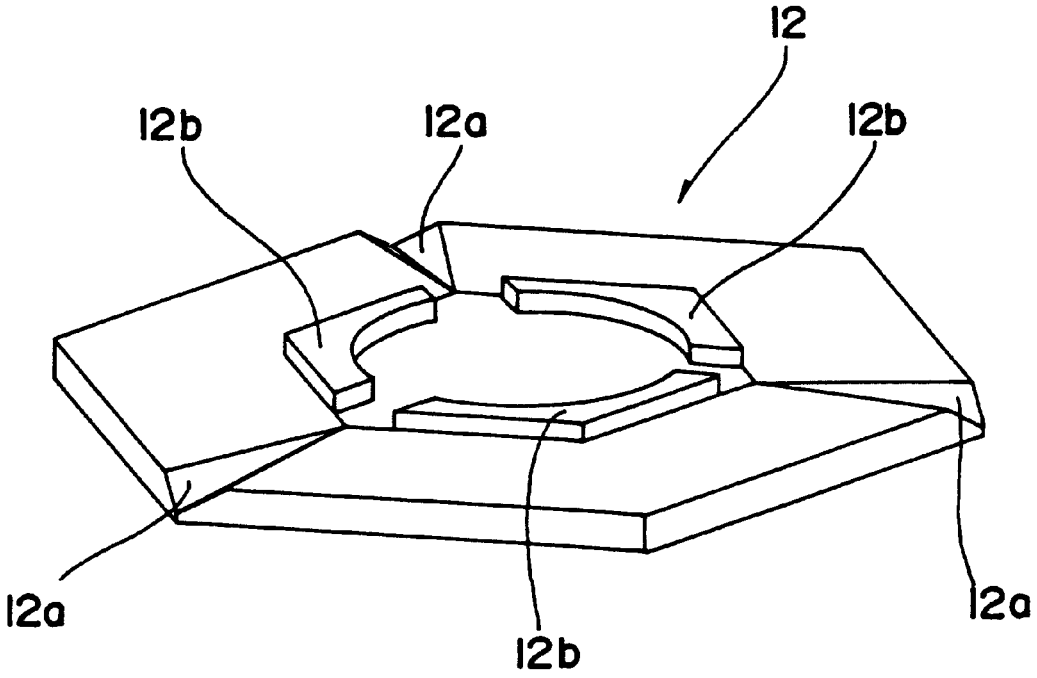
FIG. 9 illustrates an embodiment of the projections where drainage grooves are formed.
Figure 9:
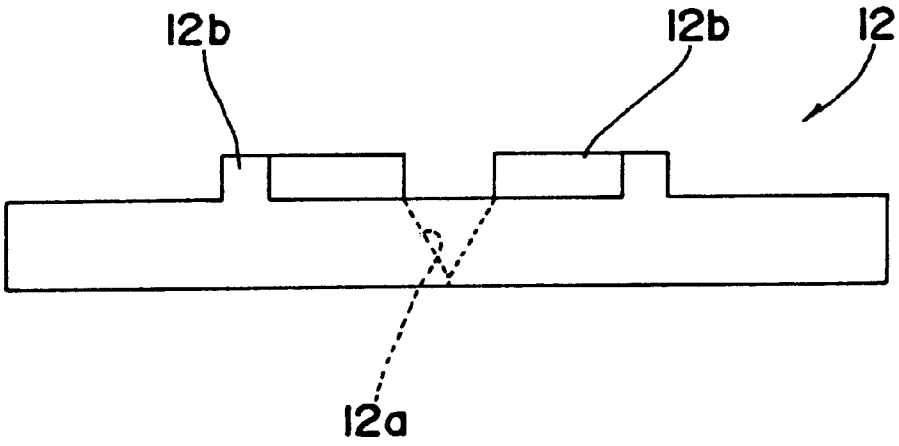

It is to be noted that in place of the foregoing projections 9, projections may take the forms illustrated in FIGS. 7 to 9.

A projection 10 in FIG. 7 is formed of sloped surfaces 10*a* having six surfaces sloping downward and a small flat protrusion 10*b* disposed in the central part, the projection 10 and the small protrusion 10*b* are in a planar shape of regular hexagon, respective sides of the projection and the small protrusion are positioned mutually parallel. It will be appreciated that since the small protrusion 10*b* stands upright from the sloped surfaces 10*a* in this embodiment, the frictional force against tires can be increased to provide the slip and skid prevention effect and, at the same time, the quick discharge of rainwater and dirt as a result of sloped surfaces 10*a* is made possible. As shown by the dashed and dotted lines in a view (a) thereof, the small protrusion 10*b* can take a posture rotated by 30 degrees. In this case, in combination with the corners of the projection 10, planar shapes with corners in 12 directions can be made so that, despite a variety of advancing directions of tires, the frictional force can be maintained at high levels.

A projection 11 illustrated in FIG. 8 has sloped surfaces 11*a* on six surfaces in the same manner as the embodiment of FIG. 7 with small protrusions 11*b* at three locations on the upper surface of the central part. Since there is a plurality of small protrusions 11*b* in this embodiment, the frictional force against tires is further reinforced as compared to the embodiment of FIG. 7 and is effective for slip and skid prevention. Also because there is a gap between one small protrusion 11*b* and another, even if rainwater and dirt should fill a recessed portion surrounded by the small protrusions 11*b*, it is possible to quickly discharge any standing rainwater and accumulations through these gaps among the small protrusions 11*b* to the sloped surfaces 11*a*.

A protrusion 12 shown in FIG. 9 forms drainage grooves 12*a* at three locations in lieu of sloped surfaces as well as small protrusions 12*b* of the same shape as that of the embodiment in FIG. 8 in the central part. In this embodiment, it is possible to discharge rainwater and dirt quickly from the central part through drainage grooves 12*a*, therefore, accumulations of rainwater and dirt can be prevented even without sloped surfaces formed over the entire area. In addition, the frictional force against tires can be maintained at high levels by the small protrusions 12*b* in the same way as the embodiment of FIG. 8.

The small protrusions shown from FIG. 7 to FIG. 9 have a flat upper surface, but the surface may be formed of slopes and drainage grooves. As for each of the projections 9 to 12 illustrated from FIG. 6 to FIG. 9, they are designed to be formed over the depression 8 of the cover body 7 in FIG. 5. Instead, an arrangement of providing steps of depressions as shown in FIG. 2 may be applied.

For example, in FIG. 5, the projection 9 of a shape shown in FIG. 6(*a*) is formed on the flat depression 8. However, as shown in concentric circles in dashed and dotted lines in FIG. 5, that which makes up the stepped depressions 8*a* to 8*e* can be formed by making these projections 9 independent. The depressions 8*a* to 8*e* are, in the same manner as the depressions shown in FIG. 2 and FIG. 3, the shallowest at the depression 8*a* of the central part and so formed to become gradually radially deeper toward the depression 8*e* on the periphery.

So long as the cover body has stepped depressions 8*a* to 8*e*, rainwater and dirt discharged by way of sloped surfaces 9*a* from the projections 9 are quickly discharged from the outer rim 7*a* to the outside. In this manner, the depressions 8*a* to 8*e* and the projections 9 provided on the upper surface of such depressions have a discharge function for rainwater and dirt respectively so that the multiple effect will deliver even more desirable results in terms of slip and skid prevention.

In the embodiments of FIG. 2 and FIG. 5, the depressions are divided in terms of difference in levels in concentric circles, and the bottom of each depression is a flat surface, whereas each bottom may be set up as a down slope from the central part of the cover body toward the periphery or the difference in level may be formed not in concentric circles but in concentric hexagons (polygons).

Also, it is understood that the depressions may not be divided but formed consecutively, the bottom of such depressions being set up as a down slope. On the other hand, this invention does not impose any particular limitation on the planar shape of the depressions. Any shape will do. Further, there are no limitations on the methods of arranging the depressions. For instance, several combinations of each depression 9 to 12 from FIG. 6 to FIG. 9 may be arranged or these depressions may be placed not over the entire surface of the cover body but at a part thereof, so that conventionally known protruding patterns may be arranged in other parts to serve also as decorations.

Figure 10:
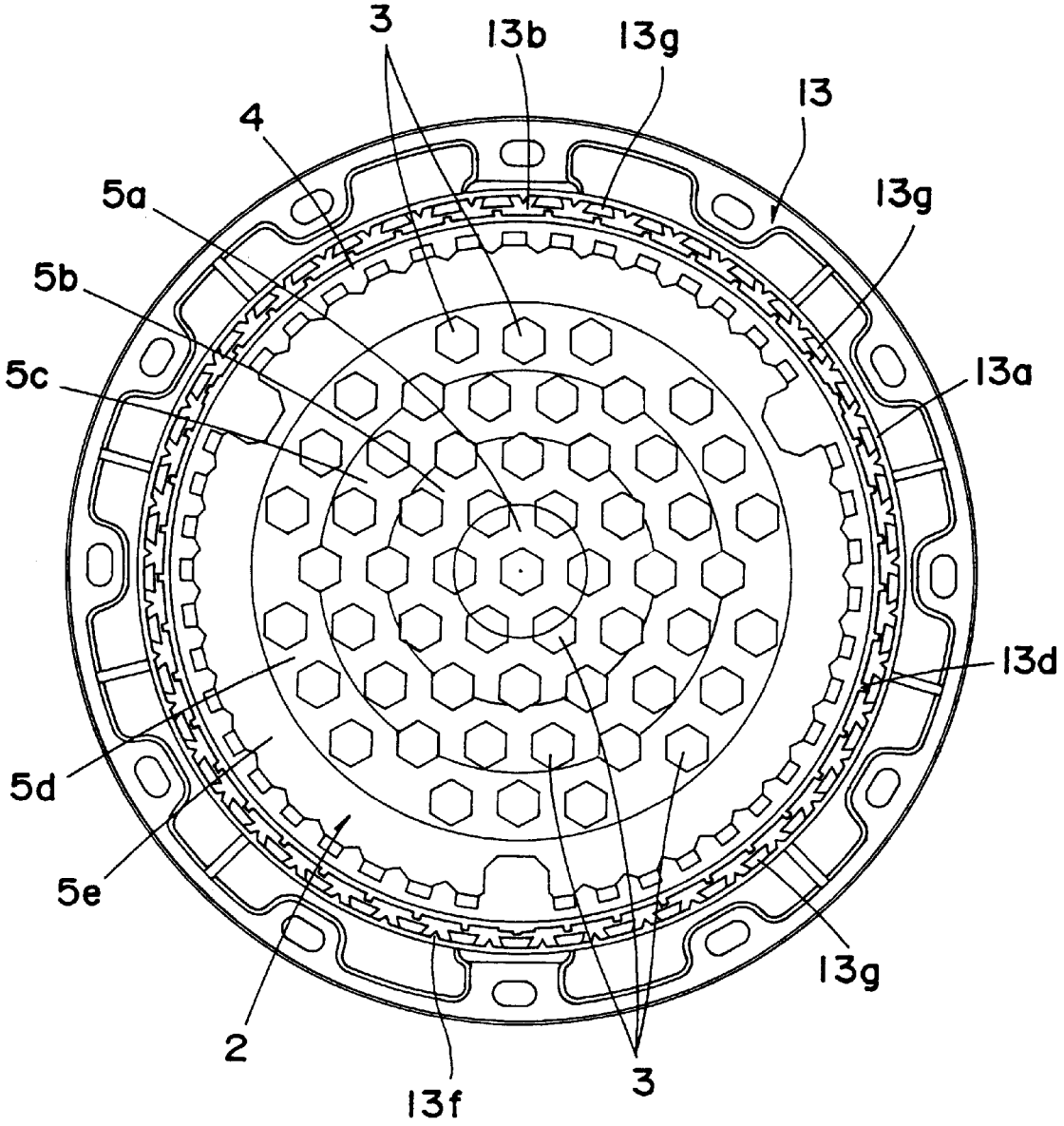
FIG. 10 is a plan view showing a cover body supportingly inserted into a frame according to this invention.
Figure 11:
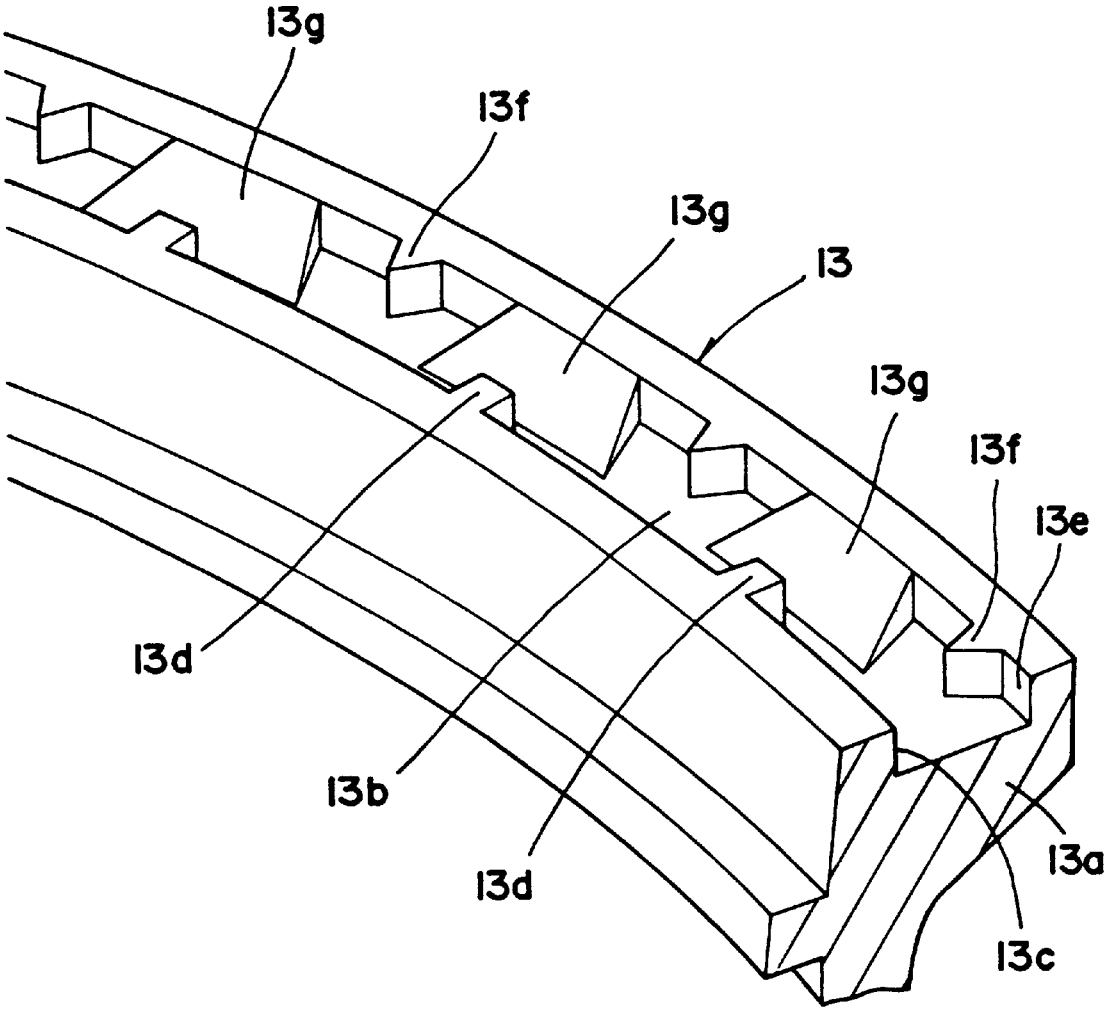
FIG. 11 is a perspective view showing a main part of the frame of FIG. 10.
Figure 12:
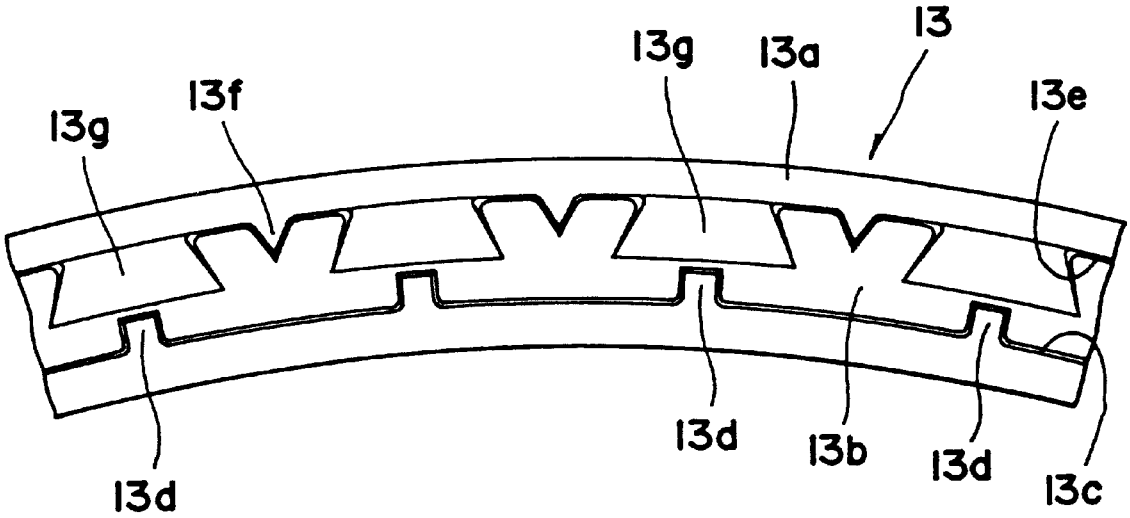
FIG. 12 is a plan view showing a main part of the frame of FIG. 10.

FIG. 10 to FIG. 13 illustrate embodiments having frames which are so constructed as to be well suited to quick discharge of rainwater and dirt. FIG. 10 shows a plan view of such embodiment. FIG. 11 and FIG. 12 are, respectively, a perspective view and a plan view of a main part of the upper section of a frame. In FIG. 10, a cover body 2 is identical to the ones shown in FIG. 1 to FIG. 4, and is supportingly inserted for the upper surface of an outer rim 4 to be on the same level as that of a frame 13.

As shown in FIG. 11 and FIG. 12, a depression 13*b* of uniform depth is provided on a flange 13*a* of the upper part of the frame 13, protrusions 13*d* having a substantially square sectional shape and jutting inside the depression 13*b* are provided on an inner peripheral wall 13*c* of the depression 13*b*, and protrusions 13*f* having a substantially triangular sectional shape and jutting inside the depression 13*b* are provided on an outer peripheral wall 13*e* thereof. Each of the protrusions 13*d* and 13*f* is placed at a specified pitch in the circumferential direction in an arrangement of offsetting each by half a pitch for an alternate turn.

Furthermore, discharge guides 13*g* are set up between protrusions 13*f* of the outer peripheral wall 13*e* to facilitate discharging rainwater and dirt. The discharge guides 13*g* are formed long in the circumferential direction as compared to protrusions 13*d* and 13*f*, as shown by a plan view of FIG. 12, with the sloped surface sloping upward to the outer periphery of the frame 13 approximately in a planar trapezoid shape having a slightly wider base.

Figure 13:
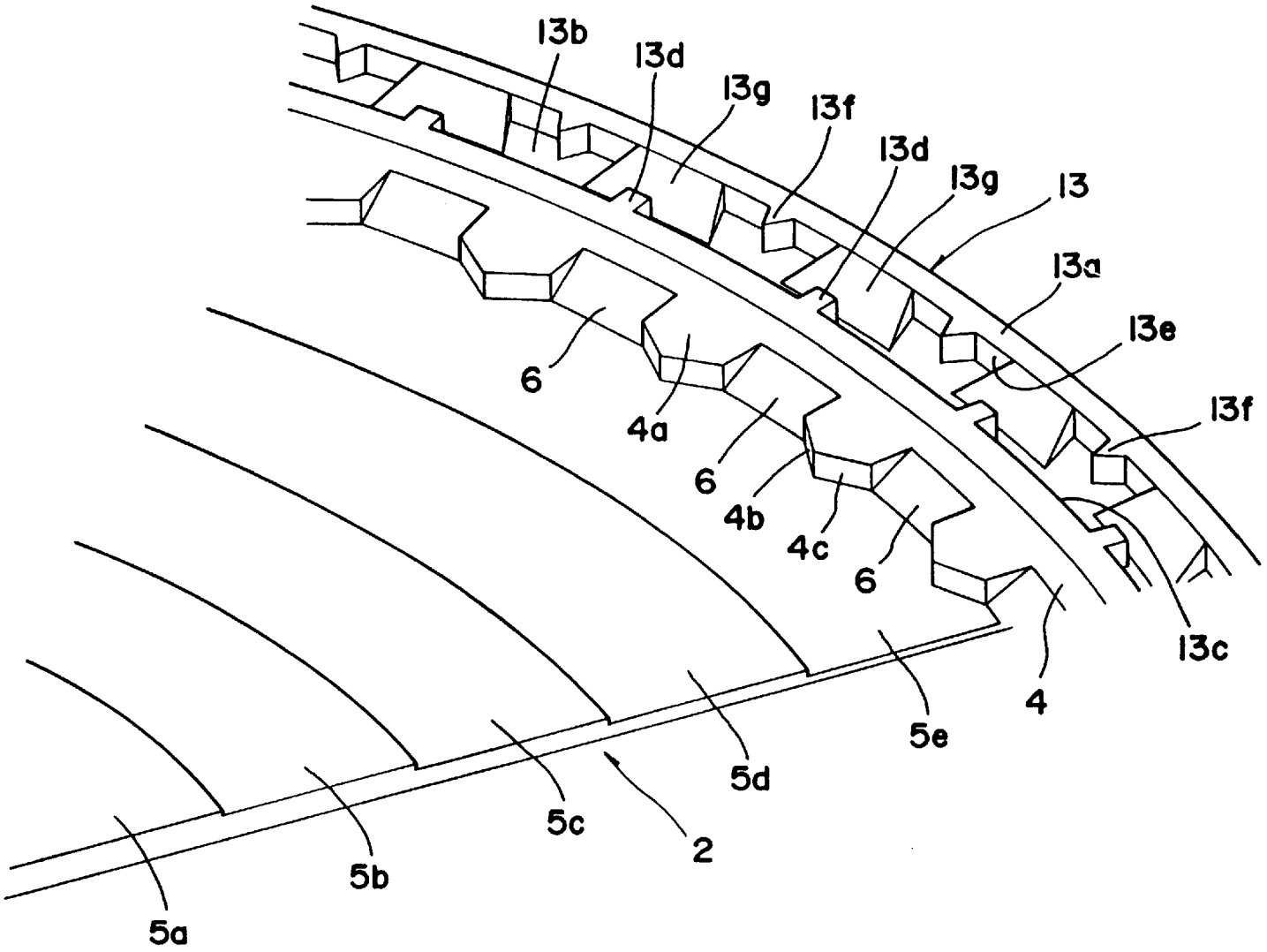
FIG. 13 is a perspective view showing a main part of a cover body supportingly inserted into a frame.

FIG. 13 is a perspective view of a main part when the cover body 2 is set onto the frame 13.

As described above, it is to be understood that when the cover body 2 is set onto the frame 13, both upper surfaces or the upper surface of the outer rim 4 and the upper surface of the flange 13*a* are to be on the same level. The positional relationship in the circumferential direction of the cover body 2 relative to the frame 13 is discretionary to some extent and there are absolutely no limitations on matching the position of the guide surfaces 6 to that of the discharge guides 13*g*.

In regard to the cover body 2, depending on the relationship of the depth of the depressions 5*a* to 5*e* thereof, it is easier to guide rainwater and dirt to the outer rim 4, and such accumulations can be quickly discharged from the guide surfaces 6 in the same way as the previous embodiment. The discharged rainwater and dirt from the cover body 2 are brought to the frame 13, whereas because of the formation of the discharge guides 13*g* thereon sloped upward to the outer periphery in the same manner as the guide surfaces 6 of the cover body 2, the rainwater and dirt pouring from the cover body 2 are quickly discharged by the passing of tires of vehicles to the outside via the discharge guides 13*g*.

In this embodiment, it is to be noted that the discharge guides 13*g* are disposed at a specified pitch with the provision of protrusions 13*f* between the discharge guides 13*g*, while there are protrusions 13*d* placed at a fixed pitch on an inner peripheral wall 13*c* of a depression 13*b*, so that accumulations such as rainwater and dirt are quickly discharged by means of the discharge guides 13*g* and that the frictional force against tires increases due to the protrusions 13*d* and 13*f*, thus enhancing the slip and skid prevention effect.

It is to be further noted that methods of positioning the discharge guides 13*g* and the protrusions 13*d* and 13*f* are not confined to the method employed in the embodiment. For instance, the discharge guides 13*g* may be provided over the entire peripheral length of the outer peripheral wall 13*e* of the depression 13*b* with only the protrusions 13*d* being provided at a fixed pitch on the inner peripheral wall 13*c* of the depression 13*b*. It is also acceptable if only the discharge guides 13*g* are set up with no provision of protrusions 13*d* and 13*f*, and in this case, slip and skid prevention can be made by the discharge effect of discharge guides 13*g* upon discharging accumulations.

A frame and a cover body of a round shape were described in the embodiment. Needless to say, square-shaped types can be used instead.

The cover body for underground structures is so designed that the depressions thereof become gradually deeper radially from the central part of the cover body to enable the rainwater and dirt accumulated in the depressions to be guided smoothly to the periphery of the cover body, thereby preventing slipping and skidding due to rainwater and dirt.

The cover body having guide surfaces on the outer rim thereof can discharge the rainwater and dirt collected in the depression smoothly and quickly to outside the cover body, so that slipping and skidding can be prevented more effectively.

Also, by providing sloped surfaces and drainage grooves on the upper surface of the projections, discharge of rainwater and dirt from the projections proper can be performed quickly despite the provision of complicated protrusions and recesses effective for slip and skid prevention on the projections, whereby surface conditions effective for slip and skid prevention can be maintained. In addition, slip and skid prevention effect can be enhanced for those cover bodies having small protrusions and small recesses on the upper surface of the projections.

By disposing projections forming sloped surfaces, drainage grooves, small protrusions and small recesses on the cover body, wherein the depressions are formed gradually deeper radially toward the periphery with guide surfaces on the outer rim thereof, discharge of rainwater and dirt can be executed quickly, further enhancing the slip and skid prevention effect by means of the projections.

According to the frame for the cover for underground structures of this invention, by means of the discharge guides provided on the depressions thereof, the same function as that of the guide surfaces provided on the cover body operates to discharge accumulated rainwater and dirt in the depressions quickly to the outside, thereby increasing the slip and skid prevention effect of the frame proper. Moreover, in the cover for underground structures of this invention comprising said cover body and the frame, discharge of rainwater and dirt from the surface of the cover body and the frame proper can be effectively performed, hence raising the slip and skid prevention effect of the cover for underground structures as a whole even more.

The foregoing invention has been described in terms of preferred embodiments. However, those skilled in the art will recognize that many variations of such embodiments exist. Such variations are intended to be within the scope of the present invention and the appended claims.

What is claimed is:

1. A cover body for underground structures comprising projections extending upwardly from depressions in a top surface of the cover body, the projections being independent of one another and extending to a level approximately corresponding to an upper surface of a frame into which said cover body is seated, and said depressions surrounding said projections, said depressions becoming progressively deeper radially outward from a center of the cover body toward a periphery of said cover body, a change in depth of said depressions beginning proximate said center of said cover and continuing substantially to said periphery.

2. The cover body for underground structures as defined in claim 1, further comprising an outer rim formed at the periphery of the cover body, and guide surfaces sloping upwardly from one of the depressions adjacent to the outer rim to an upper surface of said outer rim.

3. The cover body for underground structures as defined in claim 2, wherein the guide surfaces are provided at a pitch in a circumferential direction with respect to the outer rim and protrusions which are contiguous with said outer rim are provided between said guide surfaces jutting toward the center of the cover body.

4. A cover body for underground structures comprising projections extending upwardly from depressions in a top surface of the cover body, the cover body having an outer periphery with an outer rim at said outer periphery, the outer rim having an upper surface, and the cover body including guide surfaces sloping upwardly from at least one of said depressions adjacent to the outer rim to the upper surface of the outer rim.

5. The cover body for underground structures as defined in claim 4, wherein the guide surfaces are formed at a pitch in a circumferential direction with respect to the outer rim of the cover body and protrusions which are contiguous with said outer rim are provided between said guide surfaces and jutting toward a center of the cover body.

6. The cover body for underground structures as claimed in any one of claims 1–5, wherein at least some of the projections each have an upper surface including sloped surfaces sloping downwardly to a periphery of said upper surface of said projections and said some of said projections each have drainage grooves in said upper surface opening to the periphery of the upper surface of the projections.

7. The cover body for underground structures as claimed in any one of claims 1–5, wherein at least some of the projections each have an upper surface including sloped surfaces sloping downwardly to a periphery of said upper surface of said projections.

8. The cover body for underground structures as claimed in any one of claims 1–5, wherein at least some of the projections each have an upper surface including drainage grooves opening to the periphery of said upper surface of said projections.

9. The cover body for underground structures as claimed in any one of claims 1–5, wherein at least some of the projections each have an upper surface including sloped surfaces sloping downwardly to a periphery of said upper surface of said projections, and said some of said projections each have small protrusions on the upper surfaces of the projections.

10. The cover body for underground structures as claimed in any one of claims 1–5, wherein at least some of the projections each have an upper surface including drainage grooves opening to the periphery of said upper surface of said projections, and said some of said projections each have small protrusions on the upper surfaces of the projections.

11. The cover body for underground structures as claimed in any one of claims 1–5, wherein at least some of the projections each have an upper surface including sloped surfaces sloping downwardly to a periphery of said upper surface of said projections, and said some of said projections each have small recesses in the upper surfaces the projections.

12. The cover body for underground structures as claimed in any one of claims 1–5, wherein at least some of the projections each have an upper surface including drainage grooves opening to the periphery of said upper surface of said projections, and said some of said projections each have small recesses in the upper surfaces of the projections.

13. A cover structure for underground structures comprising a cover body and a frame, said cover body including projections on a top surface of the cover body extending upwardly from depressions in said top surface, the projections being independent of one another and extending to a level approximately corresponding to an upper surface of said frame, said depressions surrounding said projections, said depressions becoming progressively deeper radially outward from a center of the cover body toward a periphery of said cover body, and said frame including depressions provided in a circumferential direction on at least part of the upper surface of the frame and discharge guides sloping upwardly from bottoms of said depressions in said frame to a periphery of the frame.

14. A cover structure for underground structures comprising a cover body and a frame, said cover body including projections extending upwardly from depressions in a top surface of the cover body, the cover body having an outer periphery with an outer rim at said outer periphery, the outer rim having an upper surface, the cover body including guide surfaces sloping upwardly to the outer periphery from a bottom of one of the depressions adjacent to the outer rim to the upper surface of the outer rim, and said frame, on which the cover body is set, including depressions provided in a circumferential direction on at least part of an upper surface of the frame and discharge guides sloping upwardly from said depressions to a periphery of the frame.

15. A cover structure for underground structures comprising a cover body and a frame, said cover body including projections on a top surface of the cover body extending upwardly from depressions in said top surface, said projections being independent of one another such that said depressions surround said projections, said projections each having an upper surface which is a sloped surface sloping downwardly to a periphery said upper surface of said projections and said upper surface of said projections having drainage grooves opening to the periphery of the upper surface of the projections, and said frame, on which the cover body is set, including depressions provided in a circumferential direction on at least part of the upper surface of the frame and discharge guides sloping upwardly from said depressions of said frame to a periphery of the frame.

16. A cover structure for underground structures comprising a cover body and a frame, said cover body including projections on a top surface of the cover body extending upwardly from depressions in said top surface, said projections being independent of one another such that said depressions surround said projections, said projections each having an upper surface including drainage grooves opening to the periphery of said upper surface of said projections, and said frame, on which the cover body is set, including depressions provided in a circumferential direction on at least part of the upper surface of the frame and discharge guides sloping upwardly from said depressions in said frame to the periphery of the frame.

* * * * *